US007059092B2

(12) United States Patent
Harkins et al.

(10) Patent No.: US 7,059,092 B2
(45) Date of Patent: Jun. 13, 2006

(54) FIRE-RESISTANT WOOD ASSEMBLIES FOR BUILDING

(75) Inventors: Jim Harkins, Edmonds, WA (US); John Gaydos, Kent, WA (US)

(73) Assignee: Washington Hardwoods Co., LLC, Seattle, WA (US)

( * ) Notice: Subject to any disclaimer, the term of this patent is extended or adjusted under 35 U.S.C. 154(b) by 0 days.

(21) Appl. No.: 10/374,927

(22) Filed: Feb. 25, 2003

(65) Prior Publication Data

US 2003/0167709 A1 Sep. 11, 2003

Related U.S. Application Data

(60) Provisional application No. 60/360,191, filed on Feb. 26, 2002.

(51) Int. Cl.
*E06B 1/04* (2006.01)
*E06B 1/06* (2006.01)
*E04C 2/00* (2006.01)

(52) U.S. Cl. ..... 52/232; 52/210

(58) Field of Classification Search ..... 52/232, 52/210, 784.11

See application file for complete search history.

(56) References Cited

U.S. PATENT DOCUMENTS 3,783,567 A * 1/1974 Ollis ..... 52/232
4,307,543 A * 12/1981 Schulthess ..... 52/232 X
4,850,173 A 7/1989 Beyer et al. ..... 52/741
4,930,276 A * 6/1990 Bawa et al. ..... 52/232 X
4,993,203 A 2/1991 Tanaka et al. ..... 52/232
5,401,793 A 3/1995 Kobayashi et al.
5,417,024 A * 5/1995 San Paolo ..... 52/456
5,452,551 A * 9/1995 Charland et al. ..... 52/232
5,687,532 A * 11/1997 Torrey ..... 52/232 X
5,701,708 A * 12/1997 Taraba et al. ..... 52/210 X
5,740,635 A 4/1998 Gil et al. ..... 52/232 X
5,816,017 A 10/1998 Hunt et al. ..... 52/232 X
5,916,077 A * 6/1999 Tang ..... 52/232 X
6,115,976 A 9/2000 Gomez ..... 52/232
6,119,411 A 9/2000 Mateu Gil et al. ..... 52/232 X
6,141,923 A * 11/2000 Habicht et al. ..... 52/232 X
6,170,210 B1 1/2001 Marts ..... 52/232

(Continued)

FOREIGN PATENT DOCUMENTS

JP 05133170 A * 5/1993 ..... 52/232

(Continued)

OTHER PUBLICATIONS

International Search Report for PCT/US03/05741; mailed Sep. 17, 2003, 5 pages.

(Continued)

*Primary Examiner*—Rodney B. White
(74) *Attorney, Agent, or Firm*—Stoel Rives LLP

(57) ABSTRACT

Door and glazing frames include intumescent material positioned in a dado that is formed in a jamb side surface. Trim materials are positioned over the intumescent material to improve the appearance of the frame and to prevent tampering with and damage to the intumescent material. The jamb trim is preferably made of a cut hardwood panel having a thickness that allows heat to be transmitted to the intumescent material in the event of a fire so that the intumescent material will expand and fill a clearance space between the frame and the door or glazing. The expanded intumescent material inhibits the transmission of smoke and heat between the door and door frame. After expanding, the intumescent material will char and solidify, which may provide an added benefit of structural support for the door and or glazing.

27 Claims, 6 Drawing Sheets

U.S. PATENT DOCUMENTS

| | | | | |
|---|---|---|---|---|
| 6,405,502 | B1 * | 6/2002 | Cornwall | 52/232 X |
| 6,421,968 | B1 | 7/2002 | Degelsegger | 52/784.11 X |
| 6,434,899 | B1 | 8/2002 | Fortin et al. | 52/232 |
| 6,550,196 | B1 * | 4/2003 | Braybrook | 52/232 X |
| 6,606,831 | B1 * | 8/2003 | Degelsegger | 52/232 X |
| 6,668,499 | B1 * | 12/2003 | Degelsegger | 52/232 X |
| 6,745,526 | B1 * | 6/2004 | Autovino | 52/232 |
| 2001/0018814 | A1 | 9/2001 | Degelsegger | 52/232 |
| 2003/0024184 | A1 | 2/2003 | Orr, Jr. et al. | 52/211 |
| 2004/0016191 | A1 * | 1/2004 | Whitty | 52/232 |

FOREIGN PATENT DOCUMENTS

| | | | | |
|---|---|---|---|---|
| JP | 05302479 A | * | 11/1993 | 52/232 |

OTHER PUBLICATIONS

VT Industries, Inc., Architectural Wood Doors, http://www.vtindustries.com/doors/OPGFireDoorsPositivePressureFireDoorsMain.html, visited Feb. 12, 2002.

VT Industries, Inc., Positive Pressure Fire Door Installation Instructions, http://www.vtindustries.com/doors/OPGFireDoorsPositivePressureFireDoorInstallationInstructionsMain.html, visited Feb. 12, 2002.

VT Industries, Inc., Useful Jobsite Information for VT Architectural Doors, date unknown.

VT Industries, Inc., When You're Choosing Wood Fire Doors . . . Think Positive, date unknown.

Summit Door Incorporated, FlameTech® Series Fire Rated Wood & Glass Systems, Jun. 2000 and Feb. 2001.

PEMKO, HSS2000 Dadoed in Frame Edge Sealing System—Wood Door x Softwood Frame with Applied Stop, Drawing No. 09-30, Revision Date Nov. 8, 1999.

PEMKO, HSS2000 Concealed in Door Edge Sealing System—Wood Door x Softwood Frame with Applied Stop, Drawing No. 09-01, Revision Date Nov. 8, 1999.

PEMKO, HSS1000 Kerfed in Frame Edge Sealing System—Wood Door x Softwood Frame with Applied Stop, Drawing No. 08-19, Revision Date Nov. 3, 1999.

PEMKO, HSS1000 Concealed in Door Edge Sealing System—Wood Door x Hollow Metal Frame, Drawing No. 06-10, Revision Date Nov. 3, 1999.

PEMKO, HSS1000 Kerfed in Door Edge Sealing System—Wood Door x Hollow Metal Frame, Drawing No. 06-01, Revision Date Nov. 3, 1999.

PEMKO, HSS2000 Edge Sealing System—Wood Door Meeting Stile, Drawing No. 04-07, Revision Date Nov. 3, 1999.

Wood for Good Limited, Building with Wood—Fire Resisting Doorsets FAQ's, http://www.woodforgood.com/building/fdoors/frame.htm, visited Feb. 12, 2002.

Architectural Record, Positive Pressure Ripples Through the Door Industry, May 2001.

National Guard Products, Inc., Upgrade Solutions from NGP Fire Doors to Positive Pressure and 'S' Label, date unknown.

BASF AG, Intumescent Materials, 1999.

BASF AG, Palusol®—Fireboards, Feb. 18, 2002.

3M Company, 3M™ Graphite Intumescent Seal Complies With New Testing Criteria, Improves Life Safety, 2000.

3M Company, Graphite Intumescent Seal, 1999.

3M Company, Fire Barrier Moldable Putty+ Product Data, 1999.

PEMKO, HSS2000 Hot Smoke Seal, http://www.pemko.com/products/hss2000.html, visited Feb. 18, 2002.

Enviromental Seals Ltd., Envirograf®, http://www.envirograf.com/products/product038.html, visited Feb. 12, 2002.

Pilkington plc, Pilkingston Pyrostop™ Fire-Resistant Glass, 2001.

* cited by examiner

FIRE-RESISTANT WOOD ASSEMBLIES FOR BUILDING

RELATED APPLICATIONS

This application claims the benefit under 35 U.S.C. § 119(e) of U.S. Provisional Patent Application No. 60/360,191, filed Feb. 26, 2002, titled "Fire-Resistant Wood Assemblies For Building," which is incorporated herein by reference.

TECHNICAL FIELD

The present invention relates to fire resistant wood-faced assemblies for building and, in particular, wood-faced door frames, and wood-faced relite, sidelite, transom, and borrowed light frames and mullions that withstand positive-pressure fire testing necessary for enhanced fire code ratings.

BACKGROUND OF THE INVENTION

In the construction of buildings and, more particularly, the construction of institutional and commercial buildings, it is common and sometimes necessary to include interior room and space walls with door openings and interior windows called "lights" or glazing. The openings for doors and glazing are usually first roughly framed in with wall studs. Door frames and glazing frame assemblies are then attached to the studs and the assemblies are finished with wallboard, doors, and glazing.

In many commercial building interiors, wooden interior doors and door frames are preferred over metal doors and frames because exposed wood surfaces enhance the aesthetics of the interior spaces. Wood framing and mullions (including light-to-light mullions and door-to-light mullions) are also commonly used for interior glass panels including relites, sidelites (a.k.a. sidelights), borrowed lights, transom lights, vision lights, and any other light-transmitting panel installed in a wall or door (collectively, "glazed openings"). To reduce costs, wood assemblies for doors and door frames are often constructed with a shaved wood veneer adhered to the exterior of a manufactured fiber core material, such as medium density fiberboard ("MDF"). High-quality wood assemblies use similar core materials, but with a solid wood facing or trim that is precision-cut, not shaved. Typically, solid wood facing is slightly thicker than veneer, making it more durable, stronger, and longer lasting than veneer assemblies. However, solid wood surfaces typically provide more fuel for a fire than veneer, which reduces fire resistance of the assembly.

Modern fire codes and architectural practices require doors and door frames to be constructed in accordance with designs that have undergone fire testing performed by accredited testing facilities in accordance with established standard test procedures. One widely recognized test procedure is a 45-minute positive-pressure test performed by Intertek Testing Services (ITS/Warnock Hersey) of Boxborough, Mass., USA for rating in accordance with the following standards: NFPA 252, CAN4-S104, UBC 7-2 1997,ISO 3008, BS476 Part 22. Positive-pressure testing requires doors, door frames, glazed openings, and their frames and mullions to be tested as an assembly. The interior side of the assembly (facing toward the door when opened) is subjected to a furnace flame with positive pressure applied to the burn zone at a predetermined height from the bottom of the door. The tests permit only a limited amount of smoke to escape around the door and glazed openings.

In an attempt to meet positive-pressure testing requirements, known prior-art designs have included intumescent materials in the doors and door frames. When exposed to heat generated in a fire, intumescent materials quickly foam and expand, then char and solidify to provide a strong, fire-resistant seal that also inhibits the penetration of smoke around doors. Intumescent materials typically activate at temperatures in excess of 400° F., but may activate at higher or lower temperatures depending on the type of intumescent material used.

One known door frame design calls for workers at the construction site to apply adhesive-backed strips of graphite intumescent material against a door jamb surface called the rabbet (where the frame is stepped to receive the door). Such designs are subject to failure due to improper installation, tampering, and damage to the exposed intumescent material. Moreover, the only frames of this type known to comply with 45-minute positive-pressure testing are hollow metal frames.

Another known use of intumescent material is a door sold by VT Industries of Holstein, Iowa, USA that includes an intumescent strip embedded between a core of the door and a wood veneer along an edge of the door. However, to comply with 45-minute positive pressure testing, the VT Industries doors must be installed in a door frame that has been tested as an assembly with the VT Industries door. The only frames known to comply with 45-minute positive-pressure testing when used with the VT Industries door are metal frames to which intumescent material has been applied against the rabbet surface, as described above. Thus a need exists for a door frame assembly that complies with 45-minute positive-pressure test standards, which is more aesthetically pleasing and which does not expose the intumescent material to tampering and damage.

The present inventors have also recognized a need for an improved fire resistant sidelight frame. Summit Door, Inc., St. Paul, Minn., USA sells frames for sidelight openings that have successfully undergone 45-minute positive-pressure tests. This sidelite frame design uses intumescent strips inlaid against its top (header), bottom (sill), and sides (jambs) and between the glass panel and wooden stops that are fastened to the frame on both sides of the glass panel. This design requires the glass to be installed in the frame using metal glazing clips before the wooden stops are installed. The metal glazing clips are apparently necessary to provide support for the glass panel in the event of a fire. The metal glazing clips provide structural support for the glass panel, but add to the material cost as well as the time and cost involved in installing it. Thus there remains a need for aesthetically pleasing wood frames and mullions for glazed openings that will pass a 45-minute positive-pressure test without the need for expensive metal glazing clips.

SUMMARY OF THE INVENTION

A door frame assembly in accordance with the present invention includes a fire-resistant structural core and a piece of intumescent material positioned in a dado that is formed in a jamb side surface of the core proximal of a rabbet of the door frame. A jamb trim is attached to the jamb side surface of the core and positioned over the jamb side surface and the intumescent material to improve the appearance of the door frame and to prevent tampering with and damage to the intumescent material. The jamb trim is preferably made of a cut hardwood panel, but may optionally be made of veneer or other aesthetically suitable materials.

In the event of a fire, heat transmitted through the jamb trim is absorbed by the intumescent material in the door frame, causing the intumescent material to expand and fill a clearance between the door frame and the door. The expanded intumescent material inhibits the transmission of smoke and heat between the door and door frame. After expanding, the intumescent material will char and solidify, possibly providing an added benefit of structural support for the door and a protective insulating layer that shields components of the door and door frame from the fire's heat and flames.

For glazed openings, a fire-resistant wood frame assembly and a fire-resistant mullion assembly (collectively "glazing frames") are also disclosed. Glazing frames in accordance with the invention include a fire resistant core material and intumescent materials arranged in a 3-sized configuration bordering an edge of a glazing member. When exposed to fire, the intumescent material in the glazing frames expands and merges to form an intumescent clip that supports the glass panels in the glazing openings. The intumescent material is also arranged to extend past wooden glazing stops of the glazing frame to reduce a shielding and insulating effect of the glazing stops, thereby allowing the intumescent material to quickly expand, merge, and char in the event of a fire to form a strong intumescent clip.

Additional aspects and advantages of this invention will be apparent from the following detailed description of preferred embodiments, which proceeds with reference to the accompanying drawings.

DETAILED DESCRIPTION OF PREFERRED EMBODIMENTS

Figure 1:
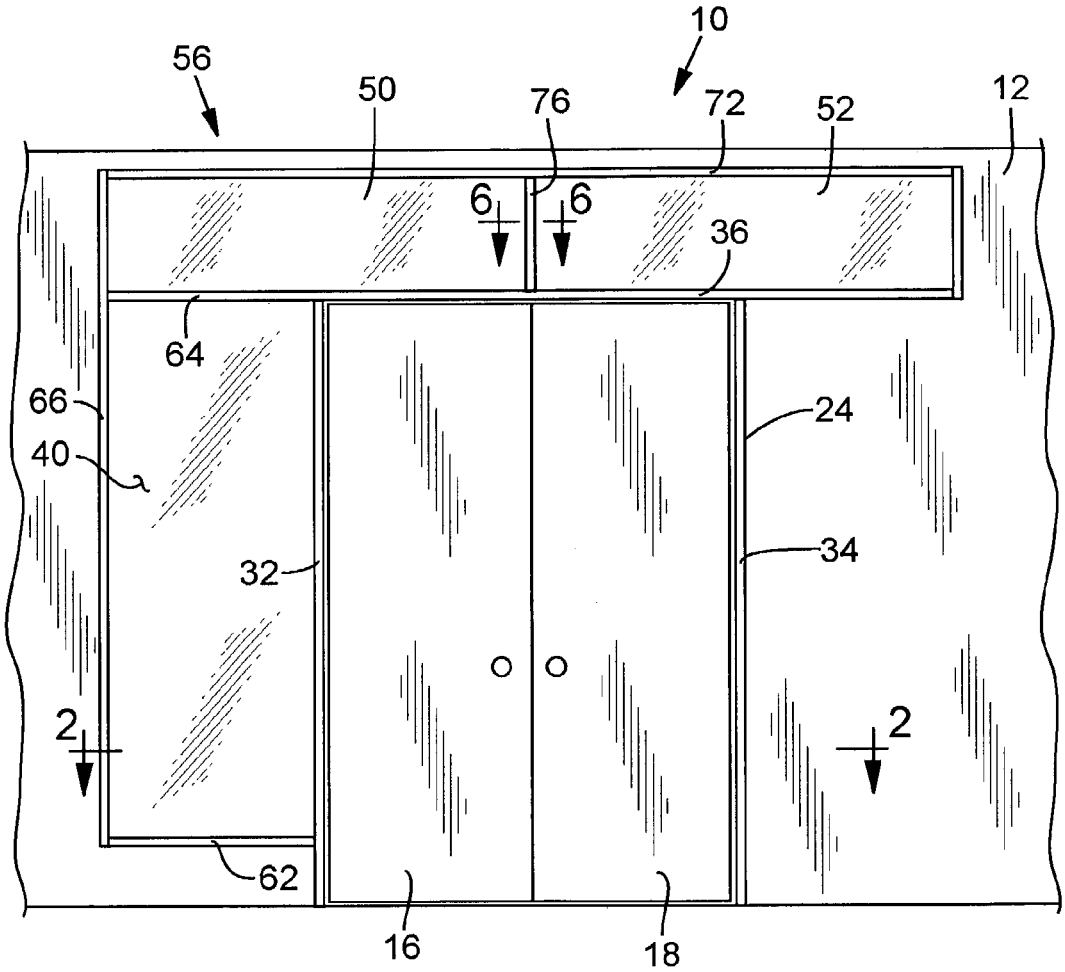
FIG. 1 is a front elevation view of an example doorway assembly configuration including framing assemblies in accordance with a preferred embodiment.

FIG. 1 is a front elevation view of a doorway and light assembly 10 installed in a wall 12 in an example configuration including framing assemblies in accordance with a preferred embodiment. With reference to FIG. 1, doorway and light assembly 10 includes a pair of doors 16 and 18 installed in a door frame 24 that includes a left side jamb 32, a right side jamb 34, and a head jamb 36. Doorway and light assembly 10 also includes a sidelite 40 and a pair of transom lights 50 and 52 (collectively "glazed openings 56"). Glazed openings 56 are framed by glazing frame members including, for example, a sidelite sill 62, a sidelite jamb 66, a transom header 72, and a transom mullion 76. Persons skilled in the art will understand that glazed openings 56 can be arranged in a variety of configurations and sizes, and include other types of glazed openings, such as, for example, relites, doorlites, and any other glass panel installed in a wall or door. Each of these glazed openings includes glazing frame assemblies that can be constructed in accordance with the present invention, embodiments of which are described below in detail.

Figure 2:
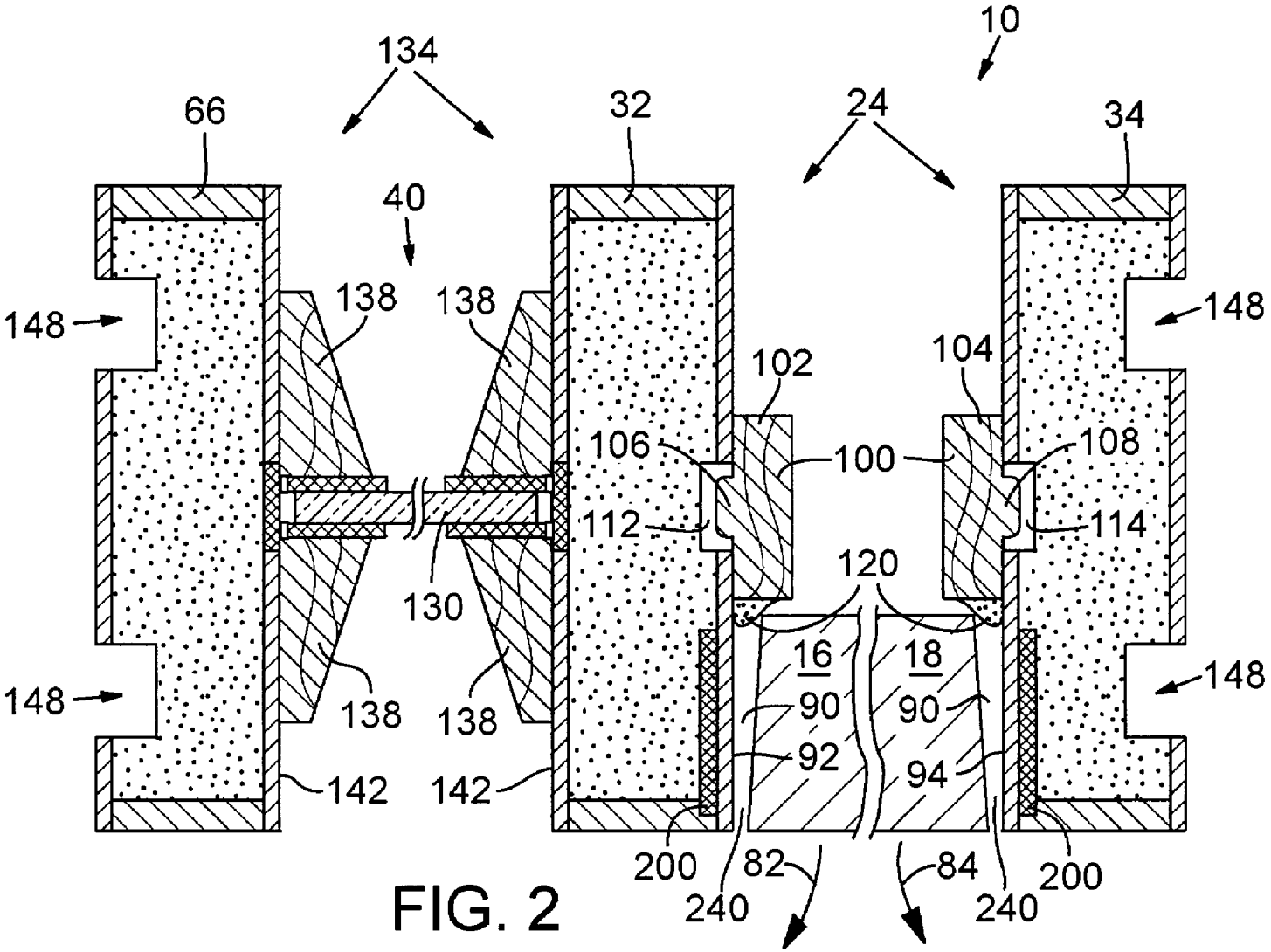
FIG. 2 is a enlarged broken sectional view of the doorway and light assembly of FIG. 1 taken along line 2—2 of FIG. 1, including a sidelite frame and a door frame.

FIG. 2 is a enlarged broken sectional view of doorway and light assembly 10 taken along line 2—2 of FIG. 1. With reference to FIG. 2, doors 16 and 18 are supported on hinges (not shown), which are attached to respective left and right side door jambs 32 and 34 so that doors 16 and 18 open inwardly in the direction shown by arrows 82 and 84. When closed, doors 16 and 18 are received in a rabbet 90 that extends along respective left and right door-side surfaces 92 and 94 of door jambs 32 and 34, as well as along a downwardly facing door-side surface (not shown) of head jamb 36. Rabbet 90 is bounded by a stop 100 against which doors 16 and 18 abut when closed. Stop 100 preferably includes left and right applied stops 102 and 104, which are typically installed at the construction site by nailing or otherwise fastening to respective left and right side door jambs 32 and 34. To facilitate installation, left and right applied stops 102 and 104 are preferably T-stops that include tongues 106 and 108 sized to fit in respective stop channels 112 and 114 formed in respective left and right door-side surfaces 92 and 94. In alternative embodiments (not shown), the stops are formed integrally with the side jamb and head jamb members 32, 34, and 36 or omitted altogether.

A flexible smoke seal strip 120 is applied to and extends along stop 100. Smoke seal strip 120 compresses when doors 16 and 18 are closed against it, to inhibit smoke from passing between doors 16 and 18 and door frame 24 in the early stages of a fire. A preferred smoke seal material is an edge sealing system sold under the trademark S88™ by Pemko Manufacturing Company of Ventura, Calif., USA. Persons skilled in the art will understand that many other smoke seal products exist and would be suitable for use with embodiments of the invention.

Continuing with reference to FIG. 2, sidelite 40 includes a sidelite glass 130 supported by sidelite jamb 66 and left side door jamb 32. Left side jamb 32 in this example is also considered a mullion because it divides a door and a sidelite, rather than being mounted to a wall. Grouped together, sidelite jamb 66, left side jamb/mullion 32, sidelite sill 62, and a sidelite head 64 (FIG. 1) are considered a glazing frame 134. Sidelite glass 130 is secured to glazing frame 134 by glazing stops 138 that are attached to jamb side surfaces 142 of glazing frame 134 during installation of sidelite glass 130, to thereby grasp or snugly pinch sidelite glass 130 between adjacent pairs of glazing stops 138.

Sidelite jamb 66 and right side doorjamb 34 include drywall grooves 148 sized to receive edges of drywall panels. For clarity, drywall panels and wall studs are omitted in FIG. 2, but shown in FIGS. 3 and 4. Skilled persons will understand that many other methods and means can be used for attaching jambs 66 and 34 to walls, studs, and drywall panels for a quality appearance. For example, in one alternative embodiment (not shown) drywall grooves 148 are moved to the edges of jambs 66 and 34 to create a T-shape that fits flush with drywall panels. In another alternative embodiment (not shown), drywall grooves 148 are omitted entirely for a flush mounted jamb called a "flatjamb." In each alternative embodiment, applied trim can be used to cover the seams between the jamb and the drywall panels.

Figure 3:
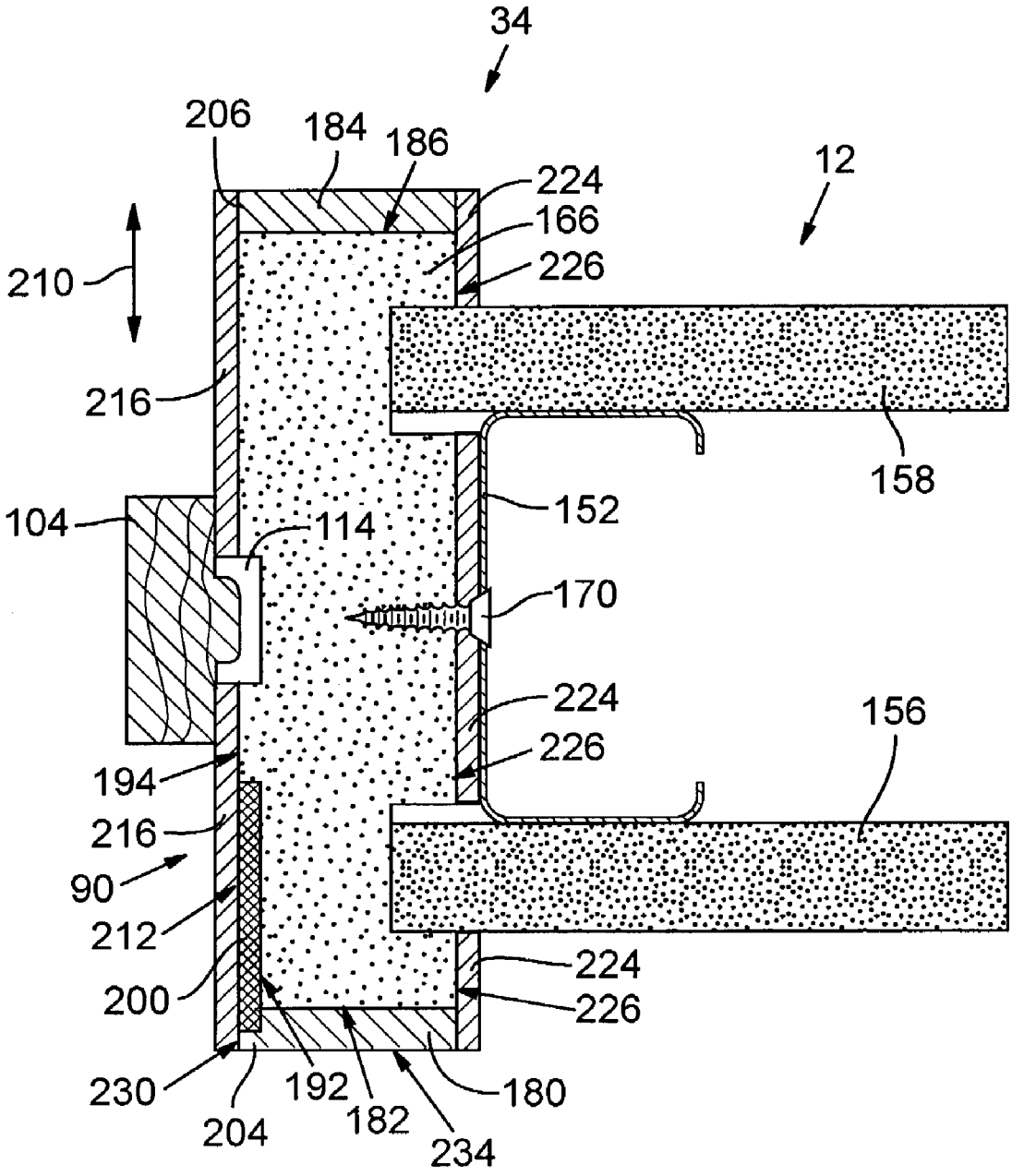
FIG. 3 is an enlarged cross section view showing detail of a right-side door jamb portion of the door frame of FIG. 2.

FIG. 3 is an enlarged cross-sectional view showing detail of right side door jamb 34 and wall 12. With reference to FIG. 3, wall 12 includes a metal C-shaped wall stud 152 that extends vertically to support a pair of drywall panels 156 and 158. Doorjamb 34 includes a fire resistant core 166 of material such as a fire resistant medium density fiberboard ("MFMDF") having a "Class 1" Underwriters Laboratory rating. In a preferred embodiment, core 166 is made of a solid piece of MFMDF material having a grain structure aligned with the long dimension of jamb 34 so that the fibers extend generally perpendicular to the section plane of FIG. 3. Orienting the fibers of core 166 in this direction increases the holding power of screws 170 that are used to attach jamb 34 to wall stud 152 and screws used to attach a hinge (not shown) to jamb 34.

The term "core" as used herein is not limited to solid cores, however, and is used herein to denote any structural member over which other materials are applied, regardless of whether solid, hollow, or having other materials mixed throughout, inserted within, or surrounded by core 166. Persons skilled in the art will also understand that materials other than MFMDF may also be suitable for use in core 166. The primary design criteria for core 166 are structural support, dimensional stability, fire resistance, holding power for screws and other fasteners, low cost, and ability to be cut into various shapes and sizes.

A process of making jamb 34 includes applying an inside face trim 180 against an inside face surface 182 of core 166. An outside face trim 184 is similarly applied to an outside face surface 186 of core 166. Inside and outside face trim 180 and 184 are preferably made of solid cut hardwood panels that are glued or otherwise adhered to respective inside and outside face surfaces 182 and 186. However, skilled persons will understand that other materials such as, for example, soft woods and veneers may also be used, as well as non-wood materials such as metal or plastic. Attachment methods other than gluing may also be used to attach face trim 180 and 184 to core 166. Once inside and outside face trim 180 and 184 have been securely adhered to core 166, a dado 192 is then cut or otherwise formed in a jamb side surface 194 of core 166 proximal of rabbet 90. Dado 192 is formed longitudinally in core 166 so that it runs the entire length of jamb 34 and rabbet 90. A strip of intumescent material 200 is then positioned in dado 192 and preferably glued or adhered to snugly fit and fill dado 192. Dado 192 and intumescent material 200 may be made between approximately 0.625 inch (⅝") and 1.750 inches wide and approximately 0.0625 inch (1/16") and 0.1875 inch (3/16") deep/thick, and are preferably approximately 1.5000 inch wide and 0.125 inch (⅛") deep/thick, but may be of other thicknesses and widths, as necessary to fit the application and the door size. To simplify assembly and manufacture, intumescent material 200 preferably includes a preapplied adhesive that is protected by a removable backing paper, which is removed before application of intumescent material 200 within dado 192.

After intumescent material 200 has been fitted in dado 192, the partly assembled jamb undergoes a sanding operation. Sanding is performed by cross sanding against jamb side surface 194 and ends 204 and 206 of respective inside and outside face trim 180 and 184 in the direction shown by arrows 210. In a preferred embodiment, a 24-grit sandpaper is used to cross-sand at a 45-degree angle to and across the longitudinal axis of jamb 34. The sanding operation ensures a flush surface at the junction between jamb side surface 194 of core 166, an outer surface 212 of intumescent material 200, and ends 204 and 206 of face trim 180 and 184. A flush and planar surface facilitates adhesion of a jamb trim layer 216, which is applied after the sanding operation. As with face trim 180 and 184, jamb trim 216 is preferably made of cut hardwood and adhered or glued to core 166, intumescent material 200, and face trim 180 and 184, but may also be made of other materials and attached in other ways within the scope of the present invention. The sanding operation described above should cause little or no abrasion of outer surface 212 of intumescent material 200. Abrasion of intumescent material 200 is undesirable because of a coating on outer surface 212 of intumescent material 200 that inhibits absorption of water and other elements that may degrade intumescent material 200 over time. Consequently, it is desirable for dado 192 to be cut slightly deeper than the thickness of intumescent material 200 so that the sanding operation will primarily affect the other components of jamb 34.

A preferred intumescent material 200 is sold by BASF Aktiengesellschaft of Ludwigshafen, Germany under the trademark PALUSOL-104®. PALUSOL-104 includes a protective coating of the type described above. Intumescent materials other than PALUSOL-104, whether coated or uncoated, may also be suitable for use in embodiments of the invention, for example, Graphite Intumescent Seal (GIS) sold by 3M Company of St. Paul, Minn., USA and HSS2000 Hot Smoke Seal sold by Pemko Manufacturing Company of Ventura, Calif., USA. Preferably, intumescent material 200 should be of the "hard puff" variety to ensure that door frame 24 is quickly sealed in the event of a fire. If an intumescent material that does not include a protective coating is used, it may be desirable to abrade outer surface 212 to encourage adhesion and close contact between jamb trim 216 and outer surface 212 of intumescent material 200.

To complete construction of jamb 34, a backing trim 224 is applied to back surfaces 226 of core 166. Stop channel 114 may also be formed centrally and longitudinally along the door side of jamb 34. As described above, applied stop 104 is preferably installed at the construction site and typically by nailing applied stop 104 to core 166. After installation of applied stop 104, smoke seal strips 120 may be installed adjacent stop 104, as described above with reference to FIG. 2.

Figure 4:
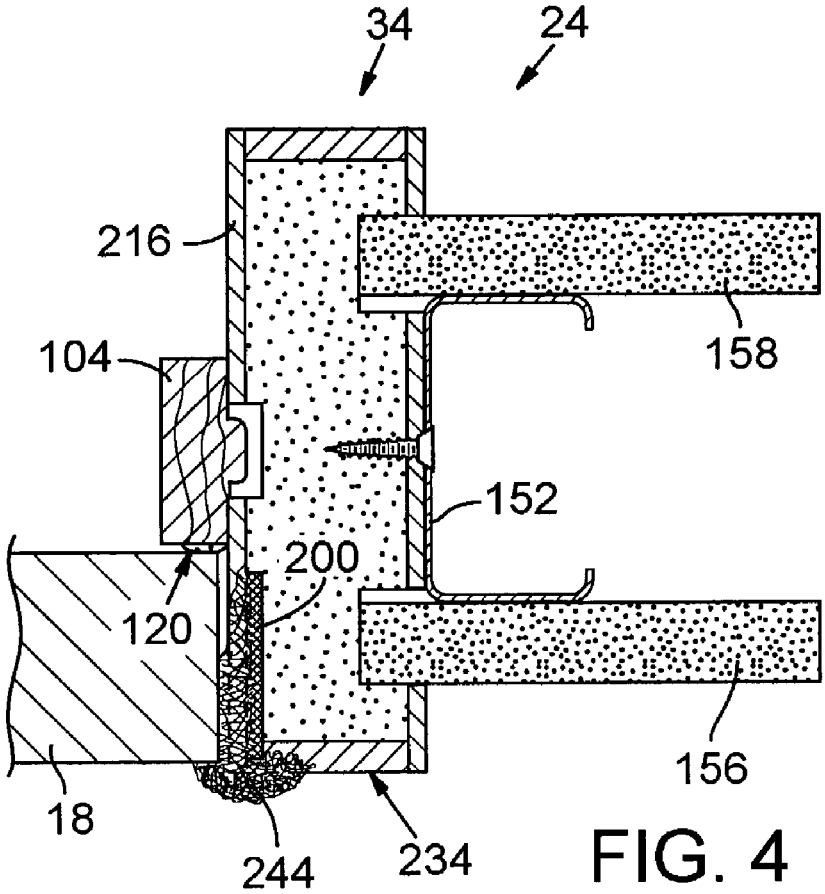
FIG. 4 is a cross section view corresponding to FIG. 3, showing how an intumescent material of the right-side door jamb reacts to a fire to prevent the spread of smoke, flames, and heat between the door and the door frame.

FIG. 4 shows how intumescent material 200 reacts to a fire burning inside of doorframe 24. At an activation temperature, intumescent material 200 begins to build pressure within dado 192. With sufficient pressure, intumescent material 200 expands and bursts through jamb trim 216 along rabbet 90 and through a seam 230 (FIG. 3) between jamb trim 216 and inside face trim 180. To facilitate acceptable timing, placement, and direction of expansion of intumescent material 200, the thicknesses of face trim 180 and jamb trim 216 are carefully selected, as is the location of dado 192 in relation to an inside face surface 234 of inside face trim 180.

More particularly, jamb trim 216 has thickness that is preferably in range of approximately 0.03125 inch (1/32") to 0.09375 inch (3/32"), and more preferably approximately 0.125 inch (⅛"). The thickness of jamb trim 216 is selected so that jamb trim 216 will bulge or fracture when intumescent material 200 expands, thereby allowing intumescent material 200 to fill and seal a clearance gap 240 (FIG. 2) when intumescent material 200 expands. The location and direction of expansion of intumescent material 200 prevent smoke, flames, and heat from passing between door 18 and jamb 34. Additionally, expansion of intumescent material 200 forms a protective insulating plug 244 that further fills and protects the junction between door 18 and door frame 24.

As noted above, dado 192 is preferably positioned in proximity to face surface 234 to increase heat transmission through inside face trim 180 and heat absorption by intumescent material 200. Preferably, dado 192 extends to within between approximately 0.0625 inch (1/16") and 0.1875 inch (3/16") of face surface 234 of inside face trim 180. It is also desirable that dado 192 extend into face trim 180, rather than being cut entirely into core 166. Extending dado 192 into inside face trim 180 facilitates timing and direction of expansion of intumescent material 200 because inside face trim 180 is consumed during early stages of a fire, whereas the fire-resistant core 166 would be likely to insulate and inhibit expansion of intumescent material 200 in a direction perpendicular to face 234. To remain structurally sound during the manufacturing process, inside face trim 180 is preferably selected to have a thickness in the range of 0.125 inch (1/8") and 0.250 inch (1/4"). Thinner face trim 180 can shatter during manufacturing when dado 192 is being cut, whereas thicker face trim 180 is more expensive and provides more fuel to burn during a fire. Furthermore, thicker face trim impedes the ability to engage a screw in core 166, thereby reducing the holding power of screws in face 234 of jamb 34 in the event of a fire that consumes inside face trim 180. A similar issue with respect to the holding power of screws arises in the context of a hinge plate (not shown) attached to jamb 34 at rabbet 90. When attaching a hinge plate, screws should be selected with a length that will penetrate fully through intumescent material 200 and into core 166 so that the screws will hold in the event of a fire, even when jamb trim 216 is consumed and intumescent material 200 expands. Accordingly, it is desirable to minimize the thickness of jamb trim 216 and intumescent material 200 as much as possible without affecting the sealing function performed by intumescent material 200 during a fire.

Figure 5:
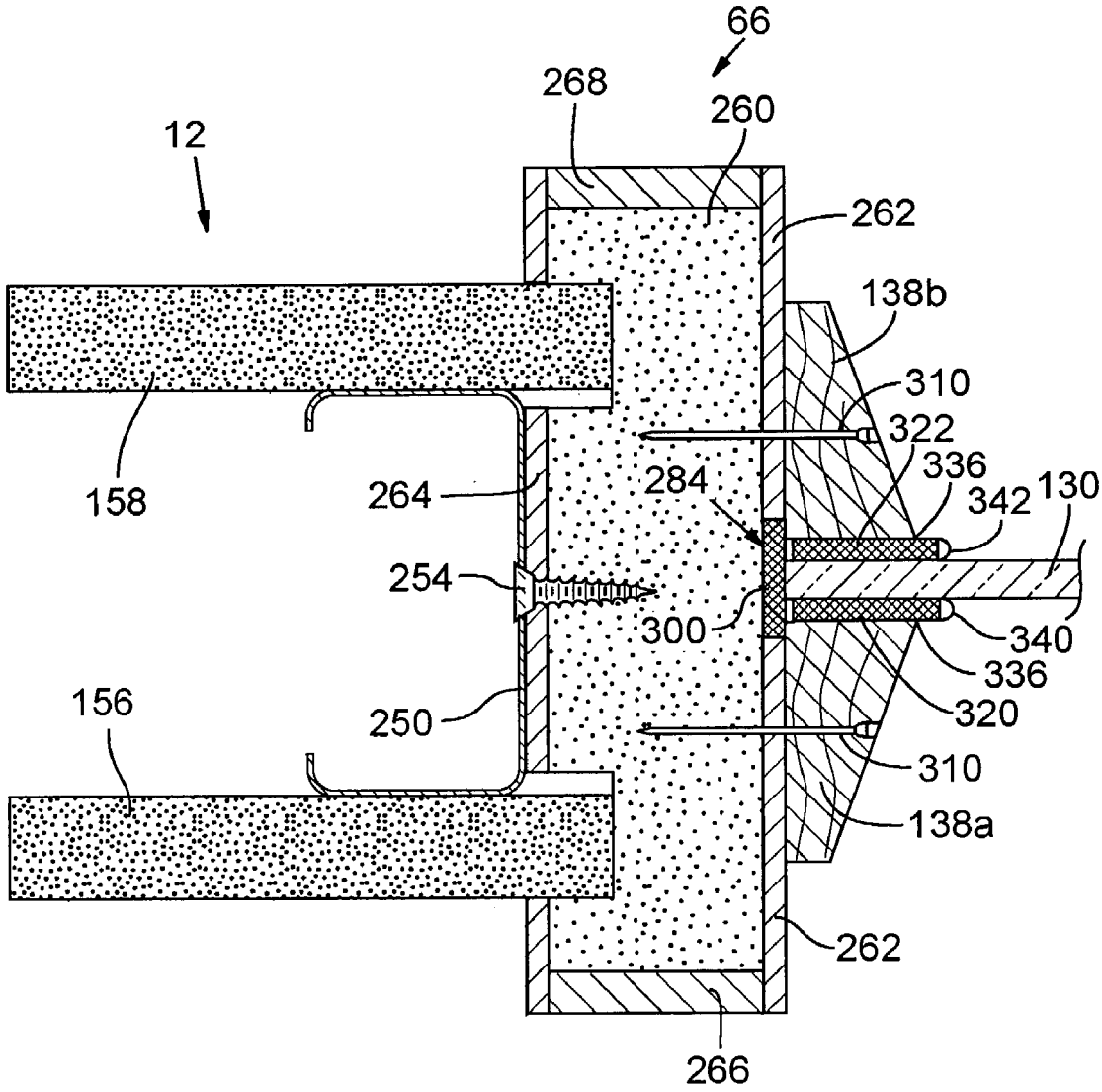
FIG. 5 is an enlarged cross section view showing detail of a sidelite jamb portion of the sidelite frame of FIG. 2.

FIG. 5 is an enlarged cross section view of sidelite jamb 66 of glazing frame 134 of FIG. 2 showing detail of wall 12. Sidelite jamb 66 is attached to a second wall stud 250 with a screw 254 and fitted to inside and outside drywall panels 156 and 158 in a manner similar to right side jamb 34 (FIG. 3 and alternative flatjamb embodiments described above). A core 260, a glass-side trim 262, a backing trim 264 and inside and outside face trim 266 and 268 are assembled in the same manner as doorjamb 34, but without the laminated and concealed strip of intumescent material 200. To minimize parts and inventories required in a manufacturing operation, sidelite jamb 66 and door jamb 34 may be made to have the same general shape, size, trim thicknesses, and materials. A glazing dado 284 is cut into a glass-side 288 of sidelite jamb 66. Glazing dado 284 is formed along the length of sidelite jamb 66 and is sized to fit a strip of intumescent material 300 (hereinafter "glass end intumescent 300"), which is adhesively secured in glazing dado 284 before sidelite glass 130 is installed. Glass-end intumescent 300 is preferably an adhesive backed strip of PALUSOL-104 ranging between approximately 0.500 inch and 1.5 inch wide and between approximately 0.0625 inch (1/16") and 0.1875 inch (3/16") thick, and are preferably 0.750 inch (3/4") wide and 0.125 inch (1/8") thick. Other types of intumescent material may be used as an alternative to PALUSOL-104.

Sidelite glass 130 and any other glazing of doorway and light assembly 10 may be made of any of a variety of types of glass, including tempered glass, security glass, insulated glass, double pane glass, and others. Special temperature rise glass may be used for sidelite glass 130 and other glazing members to increase fire resistance and enhance positive-pressure test performance. A suitable temperature rise glass is made by Pilkington plc of St. Helens, United Kingdom under the name PYROSTOP™ and sold in the United States by Technical Glass Products of Kirkland, Wash.

A pair of adjacent glazing stops 138*a* and 138*b* are nailed into sidelite jamb 66 using finishing nails 310 to support sidelite glass 130 in glazing frame 134 (FIG. 2). Glazing stops 138*a* and 138*b* are preferably made of hardwood and may optionally be treated with a fire-retardant coating. However, other materials such as plastic or metal may also be suitable. Glazing stops 138*a* and 138*b* may be made with an angled face, as shown, or with a square or rectangular cross section. Inside and outside glazing stop strips of intumescent material 320 and 322 (hereinafter "inside IM strip 320" and "outside IM strip 322") are adhered to stop faces 326*a* and 326*b* of respective inside and outside glazing stops 138*a* and 138*b* and interposed between respective glazing stops 138*a* and 138*b* and sidelite glass 130. Inside and outside IM strips 320 and 322 extend adjacent to sidelite glass 130 preferably slightly beyond distal edges 336 of glazing stops 138*a* and 138*b* to reduce a shielding and insulating effect of glazing stops 138*a* and 138*b*, thereby allowing IM strips 320 and 322 to more quickly activate in the event of a fire. IM strips 320 and 322 are preferably made of PALUSOL-104 that is wrapped in plastic sleeves 340 and 342 to enhance aesthetic appearance and discourage tampering where IM strips 320 and 322 extend from glazing stops 138*a* and 138*b*.

Pre-assembly during manufacturing of glass-end intumescent 300 and inside and outside IM strips 320 and 322 to components of glazing frame 134 reduces installation errors at construction sites, ensures proper placement of intumescent material for optimal performance, and prevents breakage of intumescent strips that can otherwise occur if shipped separately from glazing frame components.

Figure 6:
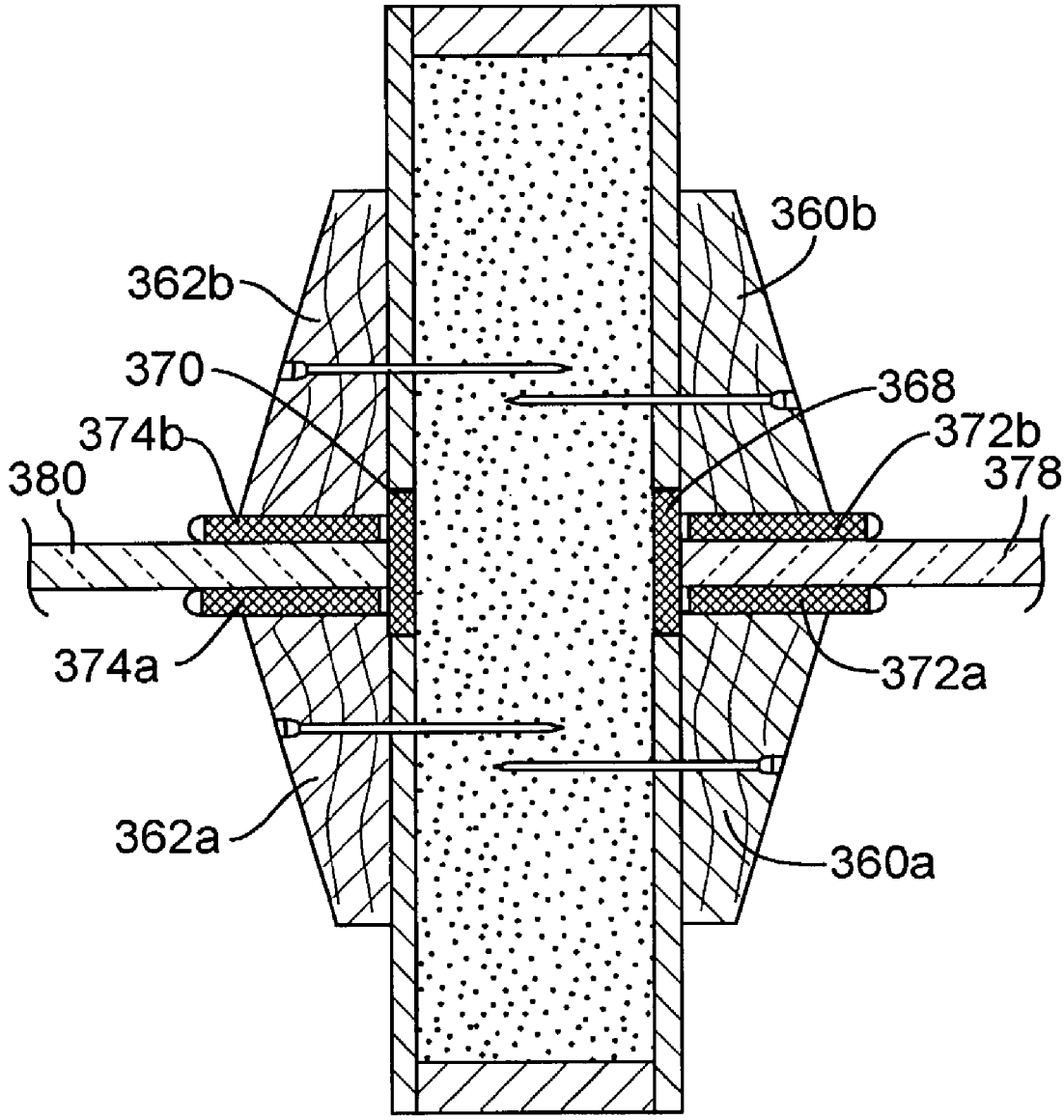
FIG. 6 is an enlarged cross section view taken along line 6—6 of FIG. 1, showing detail of a transom mullion member of a glazing frame portion of the doorway and light assembly of FIG. 1.

FIG. 6 is an enlarged cross sectional view taken along line 6—6 of FIG. 1, showing detail of a transom mullion member 76 of glazing frame 134. With reference to FIG. 6, transom mullion 76 (hereinafter "mullion") includes two sets of glazing stops 360*a*/360*b* and 362*a*/362*b*, two strips of glass end intumescent 368 and 370, and two sets of inside and outside IM strips 372*a*/372*b* and 374*a*/374*b*, for securing right and left transom glass panels 378 and 380, respectively. Other than the absence of features for attachment to a wall 12, mullion 76 is similar to sidelite jamb 66 in its arrangement and assembly at the interface with glazing 378 and 380 (as at the interface between sidelite jamb 66 and sidelite glass 130), but functions to divide two adjacent panes of glass 378 and 380 where sidelite jamb 66 does not.

Figure 7:
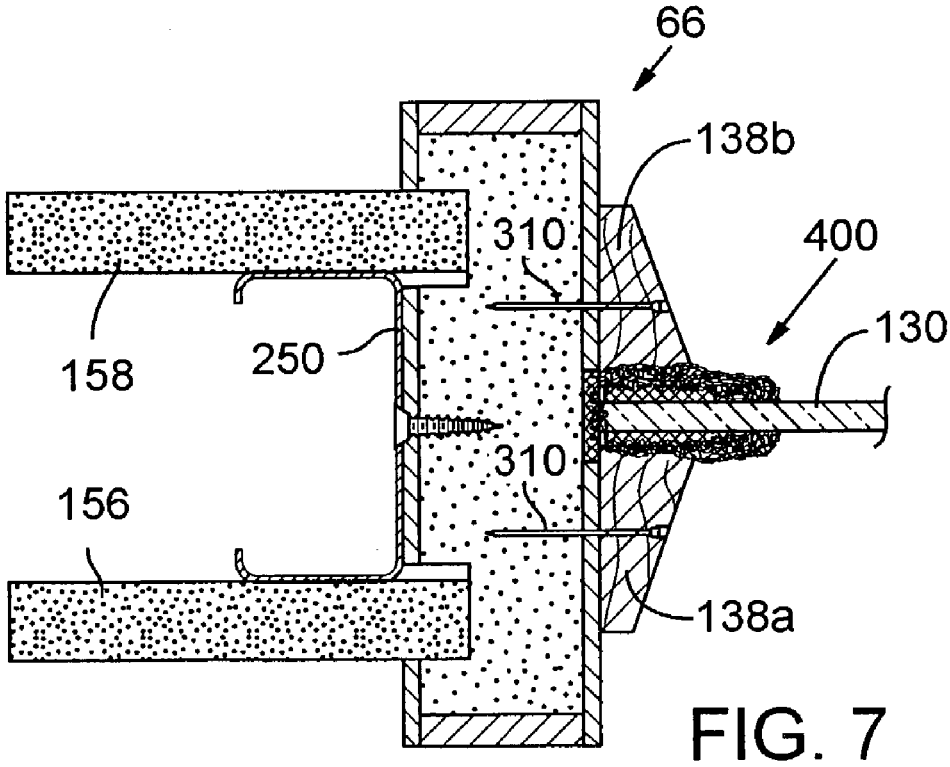
FIG. 7 is a cross section view corresponding to FIG. 5, showing how an intumescent material insert of the sidelite jamb reacts to fire.

FIG. 7 is a cross sectional view corresponding to FIG. 5 showing how glass end intumescent 300 and inside and outside IM strips 320 and 322 (FIG. 5) of sidelite jamb 66 react to fire to expand along sidelite glass 130. Due to their proximity, glass end intumescent 300 bonds with expanded IM strips 320 and 322, which then char to form a strong, unitary, fire-resistant U-shaped clip 400 that holds sidelite glass 130 in place. This clip-forming effect eliminates the need for costly metal glazing clips used in prior art glazing frames, which are time consuming and, therefore, expensive to install. Mullion 76 benefits from the same shielding and bonding effects as sidelite jamb 66 due to their similar designs.

Door frame assemblies made in accordance with the preferred embodiments described herein have been tested and certified by Underwriter's Laboratories Inc. to meet 20-minute and 45-minute positive pressure test requirements under UL 10C and UBC 7-2 (1997) Parts I and II Glazing frame assemblies made in accordance with the preferred embodiments described herein have been tested and certified by Underwriter's Laboratories Inc. to meet 45-minute and 60-minute positive pressure test requirements under ANSI/UL 263.

Persons skilled in the art will understand that the principles of the above-described embodiments of the invention are readily applied to door frames and glazing frames of a variety of shapes, sizes, configurations, and materials. It will also be obvious to those having skill in the art that many changes may be made to the details of the above-described embodiments without departing from the underlying principles of the invention. The scope of the present invention should, therefore, be determined only by the following claims.

The invention claimed is:

1. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado; and a jamb trim attached to the jamb side surface of the core and positioned over the jamb side surface and the intumescent material.

2. The improved door frame member of claim 1 in which the jamb trim is made of wood.

3. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado, the intumescent material having an outer surface that is substantially flush with the jamb side surface of the core ; and a jamb trim attached to the jamb side surface of the core and positioned over the jamb side surface and the intumescent material.

4. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado, the intumescent material extending to between ⅙ inch and 3⁄16 inch of the face surface so as to absorb heat conducted through the face surface in the event of a fire; and a jamb trim attached to the jamb side surface of the core and positioned over the jamb side surface and the intumescent material.

5. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado;

a jamb trim attached to the jamb side surface of the core and positioned over the jamb side surface and the intumescent material; and a face trim applied over the core so that the face trim forms the face surface of the jamb, the face trim being in thermal contact with the intumescent.

6. The improved door frame member of claim 5, in which the face trim is made of wood.

7. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado;

a jamb trim attached to the jamb side surface of the core and positioned over the jamb side surface and the intumescent material; and a face trim applied over the core so that the face trim forms the face surface of the jamb, the face trim and the jamb trim meeting to form a seam.

8. The improved door frame member of claim 7 in which: the dado extends into the face trim.

9. The improved door frame member of claim 7 in which the intumescent material is positioned adjacent the seam so that when intumescing, the intumescent material will separate the seam and flow through it.

10. The improved door frame member of claim 9 in which the face trim and the jamb trim are made of hardwood.

11. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the stop including an applied stop, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado;

a jamb trim attached to the jamb side surface of the core and positioned over the jamb side surface and the intumescent material; and a slot in the jamb trim sized to fit the applied stop.

12. In a door frame of the type including a jamb, a stop extending along the jamb, and a rabbet sized to receive a door that has a stile thickness and opposing first and second major surfaces, the first major surface of the door having a perimeter that is positioned adjacent the stop when the door is shut, the jamb including a face surface that extends along the jamb and that remains exposed when the door is shut, an improved door frame member comprising:

a fire-resistant structural core including a dado formed in a jamb side surface of the core proximal of the rabbet;

an intumescent material positioned in the dado;

a jamb trim attached to the jamb side surface of the core and positioned over the jamb side surface and the intumescent material; and a strip of smoke seal material applied in the rabbet to seal between the perimeter of the door and the stop when the door is closed.

13. A frame for a door or glazing, comprising:

a jamb member bordering an opening sized to accommodate a door or glazing member, a dado formed in a jamb side surface of the jamb facing the opening adjacent where a door or glazing member is to be mounted, a strip of intumescent material positioned in the dado; and a layer of hardwood trim covering the intumescent material, the hardwood trim being in thermal contact with the strip of intumescent material, the hardwood trim having a thickness sized so that in the event of a fire, the intumescent material is allowed to expand and form a seal between the frame and the door or glazing member.

14. A frame according to claim 13 that meets a 45-minute positive-pressure test.

15. A frame according to claim 13 that meets a 60-minute positive-pressure test.

16. The frame of claim 13 in which the frame is a mullion.

17. A frame for a door or glazing, comprising:

a jamb member bordering an opening sized to accommodate a door or glazing member;

a dado formed in a jamb side surface of the jamb facing the opening adjacent where a door or glazing member is to be mounted;

a strip of intumescent material positioned in the dado; and a layer of hardwood trim covering the intumescent material, the hardwood trim being in thermal contact with the strip of intumescent material, the hardwood trim having a thickness of between 1/32 inch and 3/32 inch.

18. A frame according to claim 17 that meets a 45-minute positive-pressure test.

19. A frame according to claim 17 that meets a 60-minute positive-pressure test.

20. An improved glazing frame for bordering a glazing opening in a wall, the glazing opening sized to fit a glazing member having opposing faces and a peripheral edge, the peripheral edge of the glazing member positioned adjacent the jamb, comprising:

a jamb bordering the glazing opening;

a first strip of intumescent material interposed between the jamb and the edge of the glazing member;

a first glazing stop and a second glazing stop, the first and second glazing stops spaced apart and fastened to the jamb to form therebetween a glazing slot for securing in the glazing frame the glazing member, the first and second glazing stops having respective first and second stop faces proximal of glazing slot; and a second strip of intumescent material attached to the first stop face and a third strip of intumescent material attached to the second stop face, at least a portion of the second and third strips of intumescent material remaining uncovered by the glazing stops, the second and third strips of intumescent material extending proximal of the first strip of intumescent material so that when activated the first, second, and third strips of intumescent material merge to form a unitary, fire-resistant U-shaped clip of expanded intumescent material that provides structural support for the glazing member.

21. A glazing frame according to claim 20 that meets a 45-minute positive-pressure test.

22. A glazing frame according to claim 20 that meets a 60-minute positive-pressure test.

23. The glazing frame of claim 20 in which:

the jamb includes a fire-resistant core having a dado formed therein; and the first strip of intumescent material is positioned in the dado.

24. The glazing frame of claim 20 in which the second and third strips of intumescent material are adhered to the respective first and second stop faces.

25. The glazing frame of claim 20 in which the second and third strips of intumescent material are wrapped in plastic sleeves to enhance the aesthetic appearance of the glazing frame and to prevent tampering with the second and third strips of intumescent material.

26. An improved door frame member according to claim 1 that meets a 45-minute positive-pressure test.

27. The improved door frame member according to claim 1 that meets a 20-minute positive-pressure test.

* * * * *

UNITED STATES PATENT AND TRADEMARK OFFICE

CERTIFICATE OF CORRECTION

PATENT NO. : 7,059,092 B2
APPLICATION NO. : 10/374927
DATED : June 13, 2006
INVENTOR(S) : Harkins and Gaydos It is certified that error appears in the above-identified patent and that said Letters Patent is hereby corrected as shown below:

Front Page
Abstract, line 15, change "and or" to --and/or--.

Column 11
Line 23, after "," run text from next line so line does not begin at left Signed and Sealed this Twenty-third Day of November, 2010

David J. Kappos

David J. Kappos
*Director of the United States Patent and Trademark Office*